US010162293B2

(12) United States Patent
Takahashi et al.

(10) Patent No.: US 10,162,293 B2
(45) Date of Patent: Dec. 25, 2018

(54) FIXING DEVICE AND IMAGE FORMING APPARATUS HAVING A CURVED BELT MOVING PATH AND A CURVED RECORDING MATERIAL TRANSPORTING PATH

(71) Applicant: FUJI XEROX CO., LTD., Tokyo (JP)

(72) Inventors: Masakazu Takahashi, Kanagawa (JP); Jumpei Amano, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/699,002

(22) Filed: Sep. 8, 2017

(65) Prior Publication Data

US 2018/0275573 A1 Sep. 27, 2018

(30) Foreign Application Priority Data

Mar. 21, 2017 (JP) ..... 2017-054927

(51) Int. Cl.
*G03G 15/20* (2006.01)

(52) U.S. Cl.
CPC ..... *G03G 15/206* (2013.01); *G03G 15/2053* (2013.01); *G03G 15/2085* (2013.01); *G03G 15/2028* (2013.01); *G03G 2215/2035* (2013.01)

(58) Field of Classification Search
CPC ..... G03G 15/2085; G03G 15/2089; G03G 2215/2035
USPC ..... 399/329, 323
See application file for complete search history.

(56) References Cited

U.S. PATENT DOCUMENTS 6,975,829 B2 * 12/2005 Aruga ..... G03G 15/2064 219/216
7,155,155 B2 * 12/2006 Uehara ..... G03G 15/2064 399/329
9,104,144 B2 8/2015 Okabayashi et al.
9,423,741 B1 * 8/2016 Kimura ..... G03G 15/2089
9,864,313 B2 * 1/2018 Soshi ..... G03G 15/2053
(Continued)

FOREIGN PATENT DOCUMENTS

JP 2008-233232 A 10/2008
JP 2012-73345 A 4/2012
JP 2014-44257 A 3/2014

*Primary Examiner* — Walter L Lindsay, Jr.
*Assistant Examiner* — Arlene Heredia
(74) *Attorney, Agent, or Firm* — Sughrue Mion, PLLC

(57) ABSTRACT

A fixing device includes: a belt member having a substantially loop shape and an outer circumferential surface and moving along a belt moving path; a downstream side pressing member pressed against the outer circumferential surface and pressing a recording material transported along a recording material transporting path; and an upstream side pressing member disposed on an upstream side of the downstream side pressing member, pressed against the outer circumferential surface, and pressing the recording material, wherein in a contact portion where the outer circumferential surface and the downstream side pressing member are in contact, the belt moving path and the recording material transporting path are curved toward an inner side in a radial direction of the belt member, and wherein on an upstream side of the contact portion, the belt moving path and the recording material transporting path are curved toward a side opposite to the inner side.

10 Claims, 7 Drawing Sheets

(56) References Cited

U.S. PATENT DOCUMENTS

| | | | | |
|---|---|---|---|---|
| 2015/0253707 | A1* | 9/2015 | Suzuki | G03G 15/2053 399/329 |
| 2017/0255144 | A1* | 9/2017 | Kobayashi | G03G 15/2053 |

* cited by examiner

FIXING DEVICE AND IMAGE FORMING APPARATUS HAVING A CURVED BELT MOVING PATH AND A CURVED RECORDING MATERIAL TRANSPORTING PATH

CROSS-REFERENCE TO RELATED APPLICATIONS

This application is based on and claims priority under 35 USC 119 from Japanese Patent Application No. 2017-054927 filed Mar. 21, 2017.

BACKGROUND

Technical Field

The present invention relates to a fixing device and an image forming apparatus.

SUMMARY

According to an aspect of the invention, there is provided a fixing device including: a belt member that has a substantially loop shape, has an outer circumferential surface, and moves along a belt moving path; a downstream side pressing member that is pressed against the outer circumferential surface of the belt member and presses a recording material transported along a recording material transporting path passing between the downstream side pressing member and the outer circumferential surface; and an upstream side pressing member that is disposed on an upstream side relative to the downstream side pressing member in a moving direction of the belt member, is pressed against the outer circumferential surface, and presses the recording material transported along the recording material transporting path passing between the upstream side pressing member and the outer circumferential surface, wherein in a downstream side contact portion where the outer circumferential surface of the belt member and the downstream side pressing member are in contact with each other, the belt moving path and the recording material transporting path are curved toward an inner side in a radial direction of the belt member, and wherein on an upstream side in a recording material transporting direction relative to the downstream side contact portion, the belt moving path and the recording material transporting path are curved toward a side opposite to the inner side.

BRIEF DESCRIPTION OF THE DRAWINGS

An exemplary embodiment of the present invention will be described in detail based on the following figures, wherein.

DETAILED DESCRIPTION

An embodiment of the present invention is described below with reference to the attached drawings.

Figure 1:
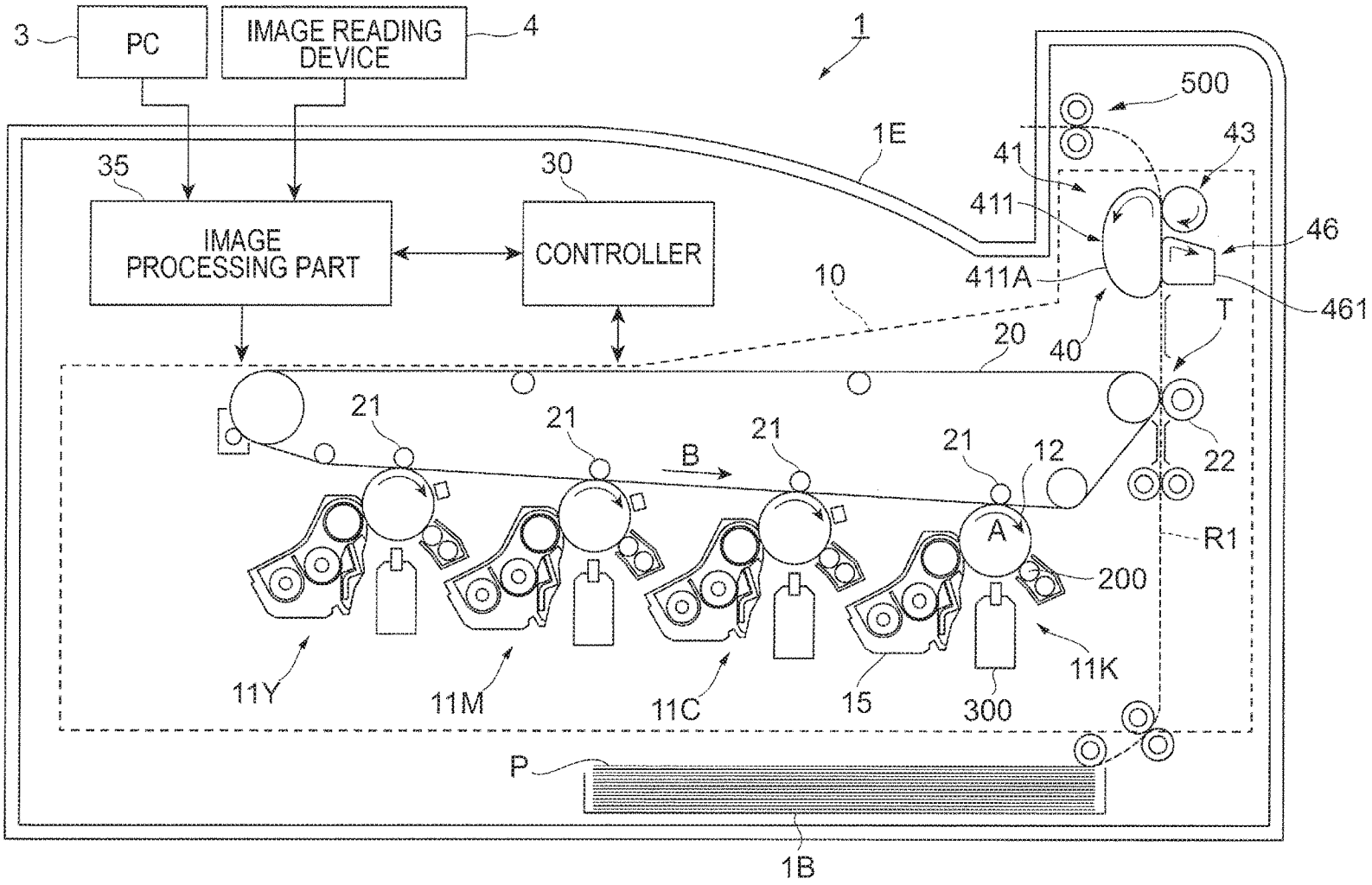
FIG. 1 illustrates an overall configuration of an image forming apparatus.

FIG. 1 illustrates an overall configuration of an image forming apparatus 1.

The image forming apparatus 1 is a tandem-type color printer. The image forming apparatus 1 includes an image forming part 10 that is an example of an image forming part. The image forming part 10 forms an image on a sheet of paper P that is an example of a recording material on the basis of image data of respective colors.

Furthermore, the image forming apparatus 1 includes a controller 30 and an image processing part 35. The controller 30 controls functional units provided in the image forming apparatus 1. The image processing part 35 performs image processing on image data supplied, for example, from a personal computer (PC) 3 or an image reading device 4.

The image forming part 10 includes four image forming units 11Y, 11M, 11C, and 11K (hereinafter sometimes collectively referred to simply as "image forming units 11") that are disposed in parallel at constant intervals.

The image forming units 11 have a similar configuration except for toner contained in a developing device 15 (described later). The image forming units 11 form yellow (Y), magenta (M), cyan (C), and black (K) toner images (images), respectively.

Each of the image forming units 11 includes a photoconductor drum 12, a charging device 200 that charges the photoconductor drum 12, and an LED print head (LPH) 300 that exposes the photoconductor drum 12 to light. The photoconductor drum 12 is charged by the charging device 200. Furthermore, the photoconductor drum 12 is exposed to light by the LPH 300, and thus an electrostatic latent image is formed on the photoconductor drum 12.

Furthermore, each of the image forming units 11 includes a cleaner (not illustrated) that cleans a surface of the photoconductor drum 12 and the developing device 15 that develops an electrostatic latent image formed on the photoconductor drum 12.

Furthermore, the image forming part 10 includes an intermediate transfer belt 20 and first transfer rolls 21 that sequentially transfer (first transfer), onto the intermediate transfer belt 20, toner images of respective colors formed on the photoconductor drums 12.

Furthermore, the image forming part 10 includes a second transfer roll 22 that collectively transfers (second transfer), onto the sheet of paper P, the toner images transferred onto the intermediate transfer belt 20 and a fixing device 40 that fixes, on the sheet of paper P, the toner images thus transferred onto the sheet of paper P.

The fixing device 40 includes a heating belt module 41 including a heating source, a driving roll 43, and a pressing belt module 46.

The heating belt module 41 is disposed on the left of a paper transporting path R1 in FIG. 1. The heating belt module 41 includes a fixing belt 411 that is an example of a belt member. The fixing belt 411 is an endless belt and circulates in a counterclockwise direction in FIG. 1. The heating belt module 41 includes the heating source (described later) that is provided on an inner side of the fixing belt 411.

The driving roll 43 that is an example of a downstream side pressing member or a recording material pressing member is a cylindrical or columnar member or a substantially cylindrical or columnar member. The driving roll 43 is disposed on the right of the paper transporting path R1 in FIG. 1. The driving roll 43 is pressed against an outer circumferential surface 411A of the fixing belt 411 and presses the sheet of paper P transported between the fixing belt 411 and the driving roll 43. In other words, the driving roll 43 presses the sheet of paper P transported on the paper transporting path R1 passing between the outer circumferential surface 411A of the fixing belt 411 and the driving roll 43.

The driving roll 43 is rotated in a clockwise direction in FIG. 1 by a motor (not illustrated in FIG. 1). When the driving roll 43 rotates in the clockwise direction, the fixing belt 411 rotates in a counterclockwise direction by receiving driving force from the driving roll 43.

In the present exemplary embodiment, the driving roll 43 is a cylindrical or columnar member or a substantially cylindrical or columnar member and performs rotary driving. The driving roll 43 gives driving force to the fixing belt 411 so as to circulate the fixing belt 411.

The pressing belt module 46 that is one example of an upstream side pressing member or a recording material pressing member is disposed on the right of the paper transporting path R1 in FIG. 1. The pressing belt module 46 is disposed on an upstream side in a moving direction of the fixing belt 411 relative to the driving roll 43.

The pressing belt module 46 is pressed against the outer circumferential surface 411A of the fixing belt 411 and presses the sheet of paper P transported between the fixing belt 411 and the pressing belt module 46. In other words, the pressing belt module 46 presses the sheet of paper P transported on the paper transporting path R1 passing between the outer circumferential surface 411A of the fixing belt 411 and the pressing belt module 46.

The pressing belt module 46 includes an endless pressing belt 461 that is capable of circulating. The pressing belt 461 rotates in the clockwise direction in FIG. 1 by receiving driving force from the fixing belt 411.

In other words, in the present exemplary embodiment, the pressing belt module 46 does not perform rotary driving by itself and instead receives driving force from the fixing belt 411. In the present exemplary embodiment, driving force is not supplied from the pressing belt module 46 to the fixing belt 411.

In the present exemplary embodiment, both of the driving roll 43 and the pressing belt module 46 are pressed against the fixing belt 411, but load of pressing of the driving roll 43 on the fixing belt 411 is set larger than load of pressing of the pressing belt module 46 on the fixing belt 411 so that driving force is supplied from the driving roll 43 to the fixing belt 411 with more certainty.

A series of processes performed in the image forming apparatus 1 are described below.

In the image forming apparatus 1, the image processing part 35 performs image processing on image data supplied from the PC 3 or the image reading device 4, and the image data that has been subjected to the image processing is supplied to the image forming units 11. Then, for example, in the image forming unit 11K for black (K), the photoconductor drum 12 is charged by the charging device 200 while rotating in a direction indicated by the arrow A and is exposed to light by the LPH 300 that emits light on the basis of the image data transmitted from the image processing part 35.

In this way, an electrostatic latent image concerning a black (K) image is formed on the photoconductor drum 12. Then, the electrostatic latent image formed on the photoconductor drum 12 is developed by the developing device 15, and thus a black (K) toner image is formed on the photoconductor drum 12.

Similarly, in the image forming units 11Y, 11M, and 11C, yellow (Y), magenta (M), and cyan (C) toner images are formed, respectively.

The toner images of the respective colors formed in the image forming units 11 are sequentially electrostatically adsorbed onto the intermediate transfer belt 20 moving in a direction indicated by the arrow B by the first transfer roll 21, and the toner images of the respective colors are thus superimposed on the intermediate transfer belt 20 so as to form a toner image.

The toner image formed on the intermediate transfer belt 20 is transported to a portion (a second transfer portion T) where the second transfer roll 22 is located by movement of the intermediate transfer belt 20. The sheet of paper P is supplied from a paper containing part 1B to the second transfer portion T in synchronization with a timing at which the toner image is transported to the second transfer portion T.

In the second transfer portion T, the toner images on the intermediate transfer belt 20 are collectively electrostatically transferred onto the sheet of paper P by a transfer electric field formed by the second transfer roll 22.

Then, the sheet of paper P on which the toner images have been electrostatically transferred is peeled off from the intermediate transfer belt 20 and is transported to the fixing device 40.

In the fixing device 40, the sheet of paper P is nipped between the heating belt module 41 and the pressing belt module 46 and is nipped between the heating belt module 41 and the driving roll 43.

In this way, the sheet of paper P is pressed and heated, and thus the toner image on the sheet of paper P is fixed on the sheet of paper P. The sheet of paper P on which the toner image is fixed is transported to a paper stacking part 1E by a discharge roll 500.

Figure 2:
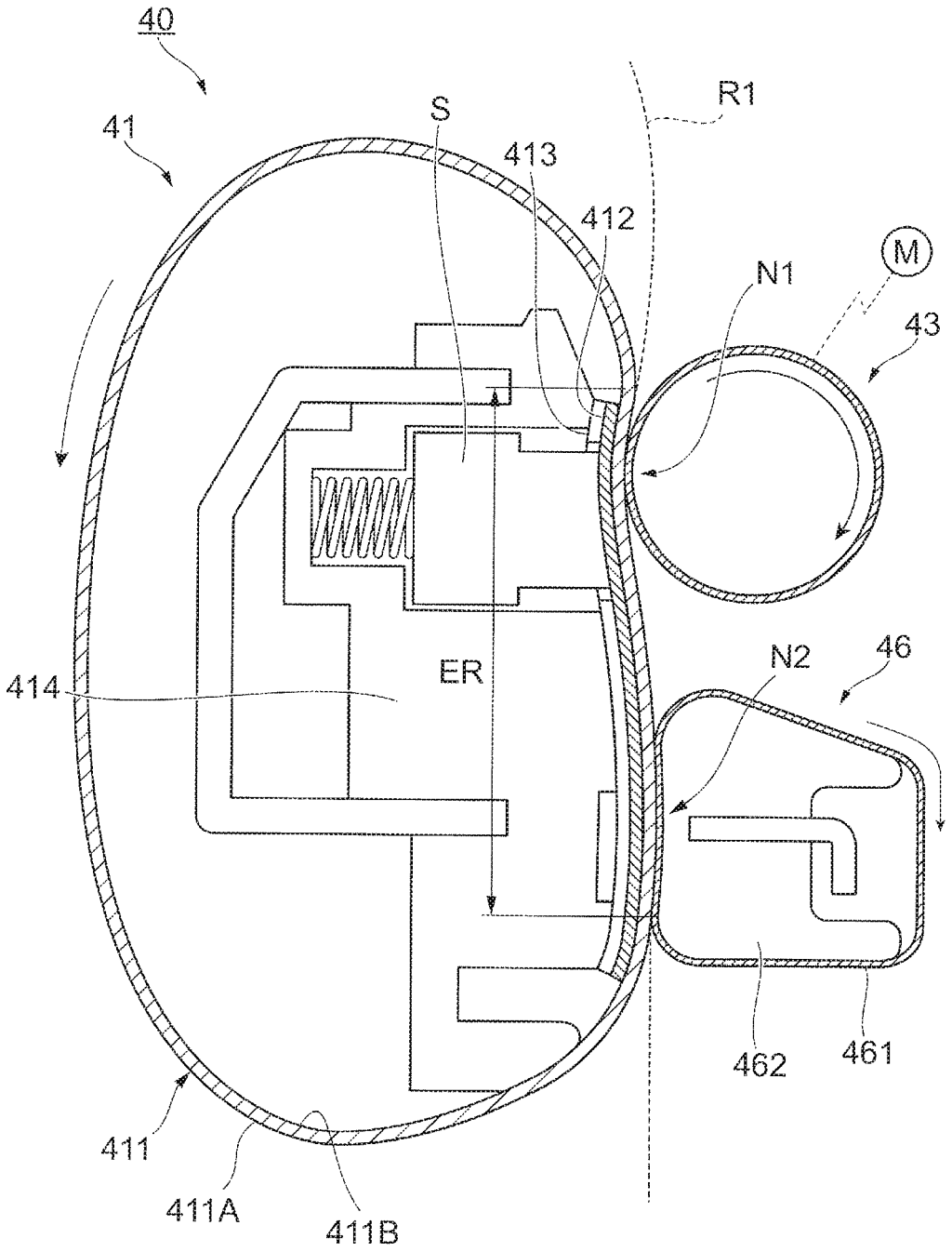
FIG. 2 is a view for illustrating a configuration of a fixing device.

FIG. 2 is a view for illustrating a configuration of the fixing device 40.

The fixing device 40 includes the heating belt module 41, the driving roll 43, and the pressing belt module 46.

The heating belt module 41 includes the fixing belt 411 used to fix the toner image on the sheet of paper P. The fixing belt 411 has a loop shape or substantially loop shape and has the outer circumferential surface 411A. The fixing belt 411 rotates in a counterclockwise direction in FIG. 2.

The heating source 412 that has a plate shape extending in the moving direction of the fixing belt 411 and a width direction of the fixing belt 411 (orthogonally to the paper on which FIG. 2 is drawn) is provided on an inner side of the fixing belt 411. In other words, a planar heat generator that extends in the moving direction of the fixing belt 411 and the width direction of the fixing belt 411 is provided on an inner side of the fixing belt 411.

In the present exemplary embodiment, the heating source 412 functions as a heating unit, and the fixing belt 411 is heated by the heating source 412. More specifically, the heating source 412 is disposed in contact with an inner circumferential surface 411B of the fixing belt 411, and the heating source 412 heats the fixing belt 411 from the inner circumferential surface 411B side in the present exemplary embodiment.

Furthermore, the heating belt module 41 includes a temperature sensor S that is an example of a temperature detector. The temperature sensor S is located so as to face the heating source 412 and detects temperature of the heating source 412.

Furthermore, the heating belt module 41 includes a heat receiving member 413 that is disposed in contact with the heating source 412 and receives heat from the heating source 412. In other words, the heating belt module 41 includes a heat capacity body that receives heat from the heating source 412 and accumulates this heat.

Furthermore, the heating belt module 41 includes a support member 414 on an inner side of the fixing belt 411. The support member 414 supports members (e.g., the heating source 412, the heat receiving member 413, and the temperature sensor S) disposed on an inner side of the fixing belt 411.

The support member 414 is made of a resin material having resistance to heat and has a heat blocking function.

The driving roll 43 rotates in a clockwise direction in FIG. 2 by receiving driving force from a motor M. In a downstream side contact portion N1, the driving roll 43 is in contact with the outer circumferential surface 411A of the fixing belt 411.

In the present exemplary embodiment, when the driving roll 43 rotates in the clockwise direction in FIG. 2, the fixing belt 411 rotates in a counterclockwise direction in FIG. 2 by receiving driving force from the driving roll 43.

The pressing belt module 46 is disposed in contact with the fixing belt 411. Specifically, in the present exemplary embodiment, in an upstream side contact portion N2 located on an upstream side of the downstream side contact portion N1, the fixing belt 411 of the heating belt module 41 and the pressing belt module 46 are in contact with each other.

The pressing belt module 46 includes the pressing belt 461 that presses the sheet of paper P. The pressing belt 461 rotates in the clockwise direction in FIG. 2 by receiving driving force from the fixing belt 411.

Furthermore, the pressing belt module 46 includes a pressing member 462 on an inner side of the pressing belt 461. The pressing member 462 is pressed against the support member 414 (the support member 414 of the heating belt module 41) with the fixing belt 411 and the pressing belt 461 interposed therebetween.

In the present exemplary embodiment, the sheet of paper P is pressed and heated while being transported from the upstream side contact portion N2 to the downstream side contact portion N1. This causes the toner image on the sheet of paper P to be fixed on the sheet of paper P.

In the present exemplary embodiment, in which the sheet of paper P is heated from the upstream side contact portion N2 to the downstream side contact portion N1, the sheet of paper P is heated over a longer region, for example, than in a case where the sheet of paper P is heated by using only a pair of roll members that are pressed against each other (than in a case where the sheet of paper P is heated in a single portion). In this case, more heat may be given to the sheet of paper P. This may lower a fixing temperature. In a case where the fixing temperature may be lowered, the fixing process may be performed by using smaller energy.

In the present exemplary embodiment, the heating source 412 is provided from the upstream side contact portion N2 to the downstream side contact portion N1. Accordingly, in the present exemplary embodiment, the whole of a region of the fixing belt 411 from the upstream side contact portion N2 to the downstream side contact portion N1 is heated.

In other words, in the present exemplary embodiment, the fixing belt 411 is heated in the upstream side contact portion N2 and the downstream side contact portion N1. Furthermore, a portion, of the fixing belt 411, located between the upstream side contact portion N2 and the downstream side contact portion N1 is also heated.

More specifically, in the present exemplary embodiment, portions of the fixing belt 411 that are located in the upstream side contact portion N2 and the downstream side contact portion N1 are heated, and a portion, of the fixing belt 411, located on a downstream side in the belt moving direction relative to the upstream side contact portion N2 and on an upstream side in the belt moving direction relative to the downstream side contact portion N1 is also heated.

In the present exemplary embodiment, this keeps a decrease in temperature of the fixing belt 411 small while the fixing belt 411 is being transported from the upstream side contact portion N2 to the downstream side contact portion N1.

In the present exemplary embodiment, the sheet of paper P is in contact with the fixing belt 411 while the fixing belt 411 is being moved from the upstream side contact portion N2 to the downstream side contact portion N1, and heat of the fixing belt 411 is absorbed by the sheet of paper P. Accordingly, the temperature of the fixing belt 411 decreases unless the heating source 412 is provided.

In a case where the heating source 412 is provided from the upstream side contact portion N2 to the downstream side contact portion N1 as in the present exemplary embodiment, heat is supplied to the fixing belt 411. This keeps a decrease in temperature of the fixing belt 411 small.

In the present exemplary embodiment, a configuration in which the heating source 412 is provided throughout the whole of the region from the upstream side contact portion N2 to the downstream side contact portion N1 (region from the upstream side contact portion N2 to the downstream side contact portion N1, including both of the upstream side contact portion N2 and the downstream side contact portion N1) has been described. However, a way in which the heating source 412 is provided is not limited to this. The heating source 412 may be provided in part of the region from the upstream side contact portion N2 to the downstream side contact portion N1.

The fixing device 40 is further described below with reference to FIG. 2.

In the present exemplary embodiment, the driving roll 43 and the pressing belt module 46 are disposed at different positions in the moving direction of the fixing belt 411 and are pressed against the outer circumferential surface 411A of the fixing belt 411.

Accordingly, in the present exemplary embodiment, a paper contact region ER that is a region where the sheet of paper P is transported in contact with the outer circumferential surface 411A of the fixing belt 411 is formed.

In the paper contact region ER, the sheet of paper P transported along the paper transporting path R1 is transported toward a downstream side while making contact with the outer circumferential surface 411A of the fixing belt 411. During the transportation, heat is supplied from the fixing belt 411 to the sheet of paper P.

Specifically, in the present exemplary embodiment, when the sheet of paper P transported from the upstream side reaches the fixing device 40, the sheet of paper P is first pressed against the fixing belt 411 by the pressing belt module 46 so as to make contact with the outer circumferential surface 411A of the fixing belt 411.

Then, the sheet of paper P is transported to a downstream side while making contact with the outer circumferential surface 411A and reaches the downstream side contact portion N1. Then, after the sheet of paper P passes the downstream side contact portion N1, the sheet of paper P is detached from the fixing belt 411.

In the present exemplary embodiment, during transportation of the sheet of paper P from the upstream side contact portion N2 to the downstream side contact portion N1 (during passage of the sheet of paper P through the paper contact region ER), the sheet of paper P is pressed and heated, and thus the toner image on the sheet of paper P is fixed on the sheet of paper P.

Figure 3:
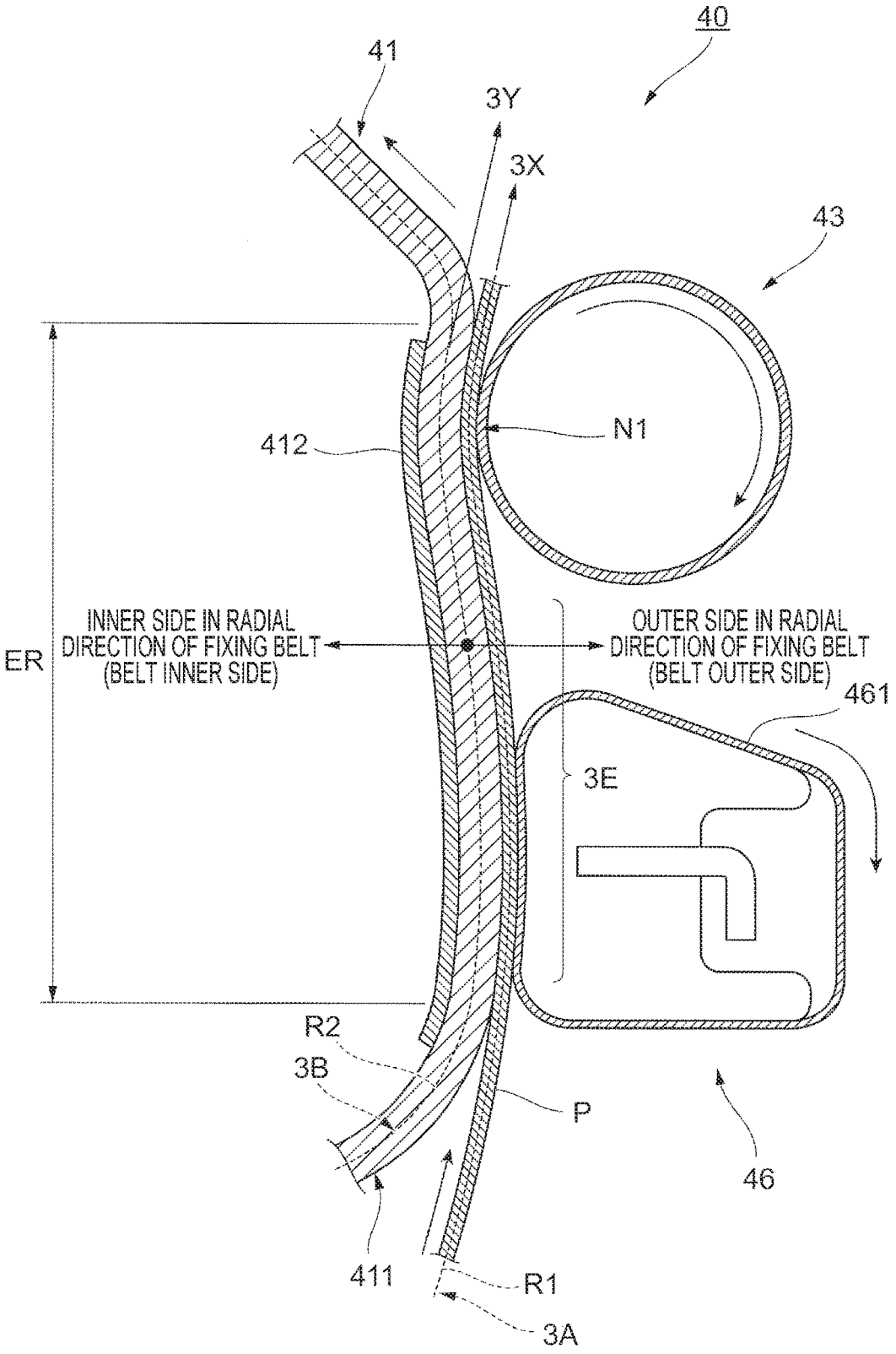
FIG. 3 is an enlarged view of a paper contact region.

FIG. 3 is an enlarged view of the paper contact region ER.

In the paper contact region ER according to the present exemplary embodiment, the paper transporting path R1 is formed along the broken line indicated by the reference sign "3A" in FIG. 3.

In the present exemplary embodiment, in which the fixing belt 411 passes the paper contact region ER, the fixing belt 411 moves along a belt moving path indicated by the reference sign "3B" in FIG. 3 (hereinafter referred to as a "belt moving path R2").

In the present exemplary embodiment, the paper transporting path R1 and the belt moving path R2 are not linear but are curved.

Specifically, in the present exemplary embodiment, the heating source 412 disposed on an inner side of the fixing belt 411 is disposed so as to be curved, and in the present exemplary embodiment, the fixing belt 411 is disposed along the heating source 412, and the paper transporting path R1 and the belt moving path R2 are curved accordingly.

A direction in which the paper transporting path R1 and the belt moving path R2 are curved is described below.

In the downstream side contact portion N1 where the fixing belt 411 and the driving roll 43 are in contact with each other, the paper transporting path R1 and the belt moving path R2 are curved toward an inner side in a radial direction of the fixing belt 411 (hereinafter sometimes referred to as a "belt inner side").

On an upstream side in the belt moving direction relative to the downstream side contact portion N1 (in a portion indicated by the reference sign "3E" in FIG. 3), the paper transporting path R1 and the belt moving path R2 are curved toward an outer side in the radial direction of the fixing belt 411 (a side opposite to the inner side of the fixing belt 411) (hereinafter sometimes referred to as a "belt outer side").

More specifically, in the present exemplary embodiment, in the downstream side contact portion N1, the paper transporting path R1 and the belt moving path R2 have curvature and bulge toward the belt inner side.

On the upstream side relative to the downstream side contact portion N1, i.e., in the paper contact region ER other than the downstream side contact portion N1, the paper transporting path R1 and the belt moving path R2 have curvature and bulge toward the belt outer side.

More specifically, in the present exemplary embodiment, in the downstream side contact portion N1 where the driving roll 43 that presses the fixing belt 411 by the largest pressing load and the fixing belt 411 are in contact with each other, the paper transporting path R1 and the belt moving path R2 are curved toward the belt inner side.

Meanwhile, in the paper contact region ER other than the downstream side contact portion N1, the paper transporting path R1 and the belt moving path R2 are curved toward the belt outer side.

In the present exemplary embodiment, plural pressing members (e.g., the driving roll 43 and the pressing belt module 46) that press the sheet of paper P are provided.

In the present exemplary embodiment, the paper transporting path R1 and the belt moving path R2 are curved toward the belt inner side in a contact portion (the downstream side contact portion N1) where a pressing member (the driving roll 43) that presses the fixing belt 411 by the largest pressing load among the plural pressing members is in contact with the fixing belt 411.

Meanwhile, in the paper contact region ER other than the downstream side contact portion N1, the paper transporting path R1 and the belt moving path R2 are curved toward the belt outer side.

Furthermore, in the present exemplary embodiment, the driving roll 43 that presses the fixing belt 411 by the largest pressing load performs rotary driving so as to circulate the fixing belt 411.

The pressing belt module 46 that is a pressing member other than the driving roll 43 does not perform rotary driving and does not supply driving force to the fixing belt 411. Conversely, the pressing belt module 46 receives driving force from the fixing belt 411 and is driven so as to follow the fixing belt 411.

Figure 4:
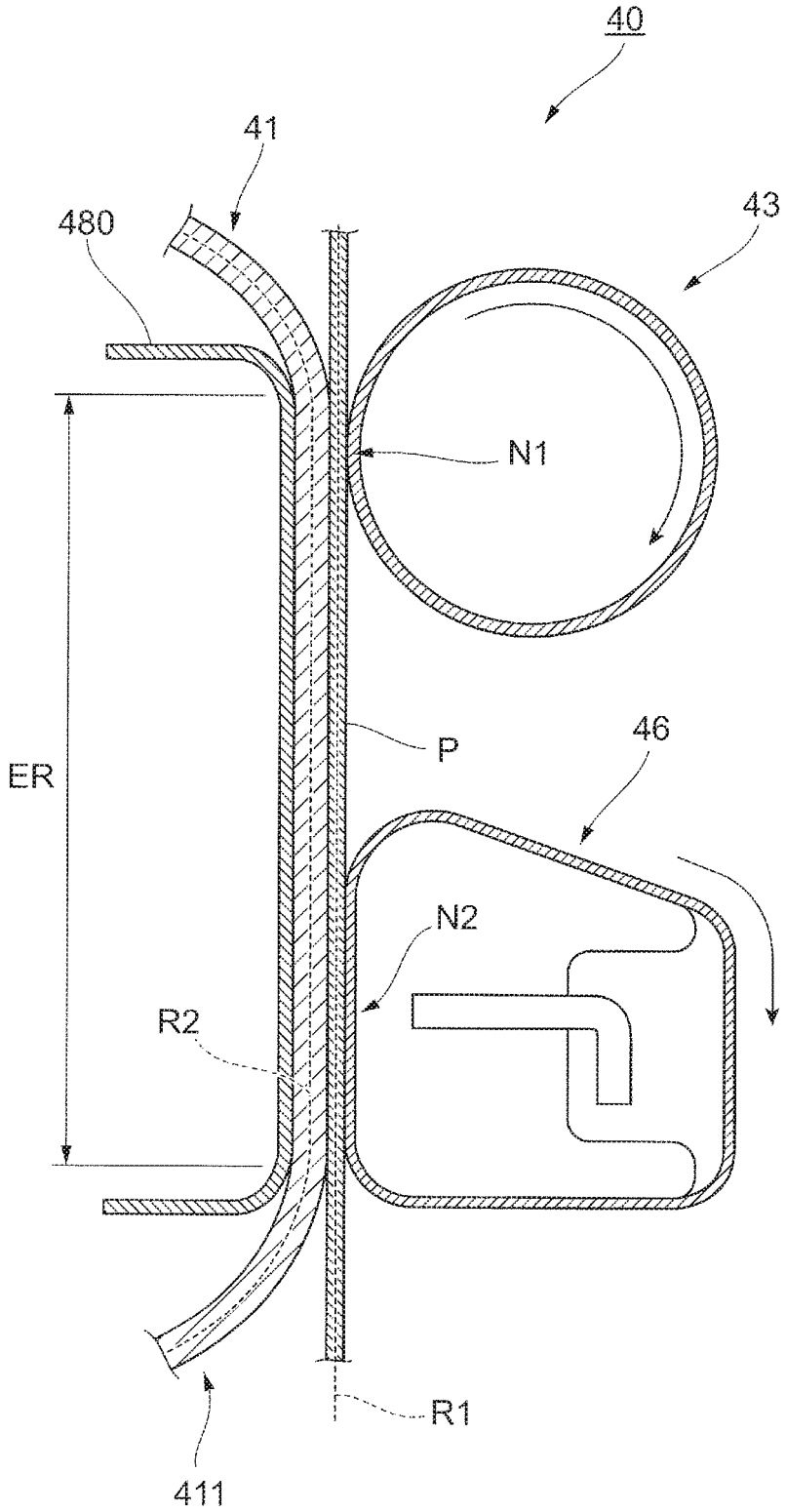
FIG. 4 illustrates a comparative example of the paper contact region.

FIG. 4 illustrates a comparative example of the paper contact region ER.

In this comparative example, the paper transporting path R1 and the belt moving path R2 are linear in the paper contact region ER unlike the present exemplary embodiment.

In this comparative example, when the fixing belt 411 reaches the downstream side contact portion N1, the fixing belt 411 is pressed (compressed in a thickness direction) by a support member 480 located on an inner side of the fixing belt 411 and the driving roll 43, the fixing belt 411 stretches along the moving direction of the fixing belt 411 (stretches in a top-bottom direction of FIG. 4).

In this case, moving velocity of the fixing belt 411 increases in the downstream side contact portion N1 and is relatively low in a portion other than the downstream side contact portion N1.

In the downstream side contact portion N1, the sheet of paper P is transported together with the fixing belt 411 that moves at a higher velocity. Accordingly, the moving velocity of the fixing belt 411 and the moving velocity of the sheet of paper P are the same in the downstream side contact portion N1.

Meanwhile, on the upstream side relative to the downstream side contact portion N1, the moving velocity of the fixing belt 411 is relatively low as described above. Accordingly, on the upstream side relative to the downstream side contact portion N1, the moving velocity of the fixing belt 411 is lower than the moving velocity of the sheet of paper P.

In this case, on the upstream side relative to the downstream side contact portion N1, the toner image on the sheet of paper P is rubbed by the fixing belt 411 moving relative to the sheet of paper P. This leads to a risk of disturbing the toner image on the sheet of paper P.

Meanwhile, in the configuration according to the present exemplary embodiment illustrated in FIG. 3, a difference in velocity that can occur between the sheet of paper P and the fixing belt 411 may be reduced, and the toner image on the sheet of paper P is less likely to be disturbed.

Specifically, in the present exemplary embodiment, in the downstream side contact portion N1, the paper transporting path R1 and the belt moving path R2 are curved toward the belt inner side as illustrated in FIG. 3.

In this case, the fixing belt 411 passes on an outer side relative to the sheet of paper P in a radial direction of the driving roll 43, and peripheral velocity of the fixing belt 411 is higher than peripheral velocity of the sheet of paper P as indicated by the arrow 3X and the arrow 3Y in FIG. 3.

In this case, the moving velocity of the fixing belt 411 on the upstream side relative to the downstream side contact portion N1 is higher and a difference in velocity between the sheet of paper P and the fixing belt 411 on the upstream side relative to the downstream side contact portion N1 is smaller than those in the comparative example illustrated in FIG. 4.

Furthermore, in the present exemplary embodiment, the paper transporting path R1 and the belt moving path R2 are curved toward the belt outer side on the upstream side relative to the downstream side contact portion N1 (in the portion indicated by the reference sign "3E" in FIG. 3) as described above.

In this case, the sheet of paper P that moves at a high velocity relative to the fixing belt 411 passes an outer route relative to the fixing belt 411 (passes a longer route on which it takes more time to travel), and therefore a difference in velocity between the sheet of paper P and the fixing belt 411 is further reduced.

Even in a case where the paper transporting path R1 and the belt moving path R2 are curved toward the belt inner side in the downstream side contact portion N1 as described above, a difference in velocity between the sheet of paper P and the fixing belt 411 sometimes occurs.

In this case, the difference in velocity between the sheet of paper P and the fixing belt 411 is reduced by curving the paper transporting path R1 and the belt moving path R2 toward the belt outer side on the upstream side relative to the downstream side contact portion N1.

Figure 5:
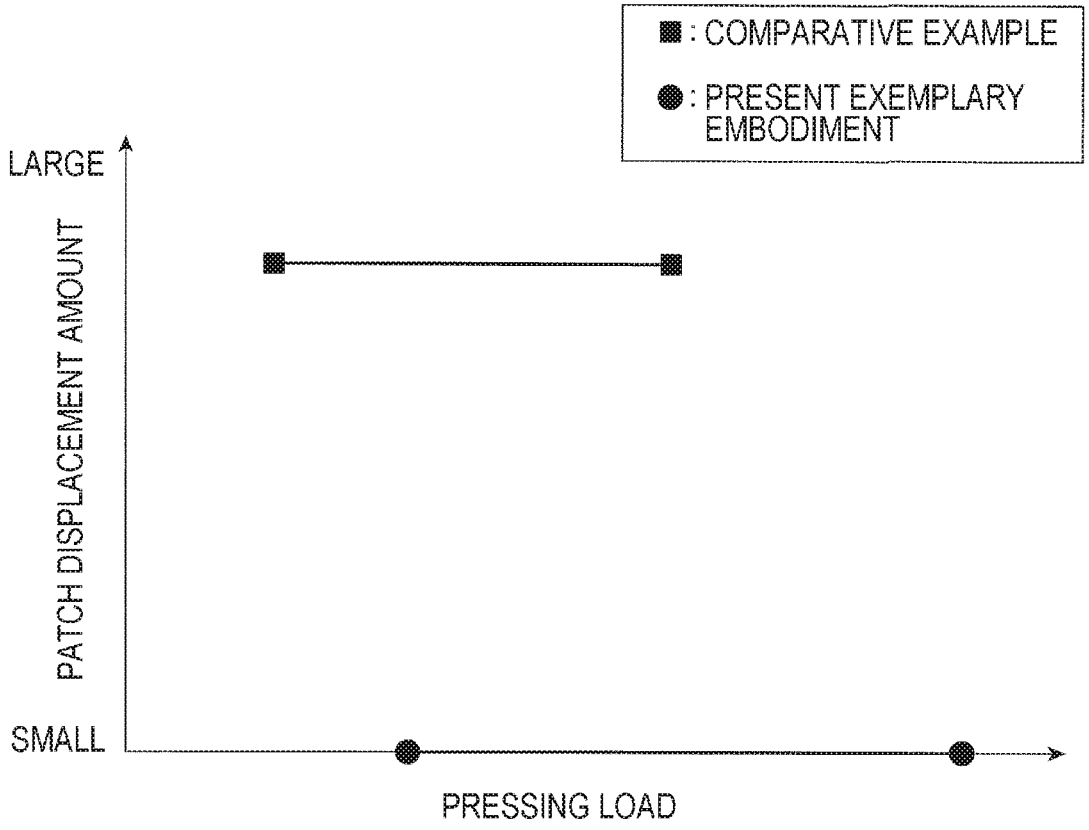
FIG. 5 illustrates a result of an experiment in the exemplary embodiment and the comparative example.

FIG. 5 illustrates a result of an experiment in the exemplary embodiment illustrated in FIG. 3 and the comparative example illustrated in FIG. 4.

In this experiment, a patch image is formed on the sheet of paper P, and the sheet of paper P is supplied to the fixing device 40 according to the present exemplary embodiment and to the fixing device 40 according to the comparative example, and the patch image that has been fixed is observed.

In FIG. 5, the vertical axis represents a displacement amount (a degree of displacement) of the patch image, and the horizontal axis represents load of pressing of the pressing belt module 46 on the fixing belt 411. Furthermore, in FIG. 5, the square dots represent a result obtained in the comparative example, and the circular dots represent a result obtained in the present exemplary embodiment.

In a case where the present exemplary embodiment and the comparative example are compared, a displacement amount of the patch image is smaller in the present exemplary embodiment, as illustrated in FIG. 5. Meanwhile, a displacement amount of the patch image in the comparative example is larger than the displacement amount in the present exemplary embodiment.

Figure 6:
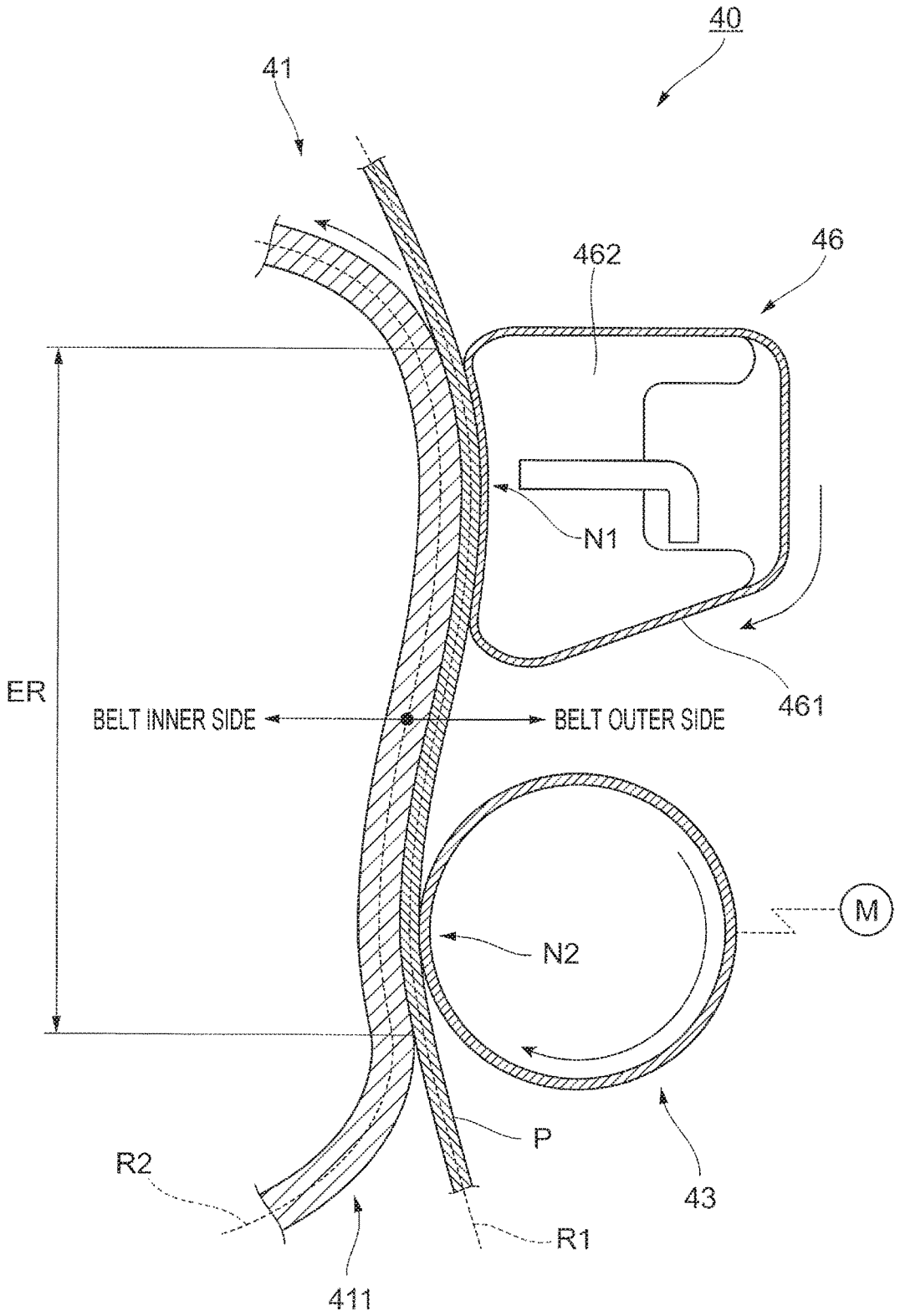
FIG. 6 illustrates another example of the configuration of the fixing device.

FIG. 6 illustrates another example of the configuration of the fixing device 40.

In this example, the driving roll 43 is disposed on an upstream side and the pressing belt module 46 is disposed on a downstream side in the moving direction of the sheet of paper P. In this example, the driving roll 43 serves as an upstream side pressing member, and the pressing belt module 46 serves as a downstream side pressing member.

In this example, the downstream side contact portion N1 is a portion where the pressing belt module 46 is pressed against the fixing belt 411, and the upstream side contact portion N2 is a portion where the driving roll 43 is pressed against the fixing belt 411.

The driving roll 43 is a cylindrical or columnar member or a substantially cylindrical or columnar member as in the above example. The pressing belt module 46 includes the pressing belt 461 and the pressing member 462.

Load of pressing of the driving roll 43 on the fixing belt 411 is set larger than load of pressing of the pressing belt module 46 on the fixing belt 411 as in the above example.

In this example, the driving roll 43 located on an upstream side performs rotary driving by receiving driving force from the motor M. The driving roll 43 gives driving force to the fixing belt 411, and thus the fixing belt 411 circulates.

As in the above example, the pressing belt module 46 does not perform rotary driving and does not supply driving force to the fixing belt 411. In other words, the pressing belt module 46 does not perform rotary driving and is driven by receiving driving force from the fixing belt 411.

In this example, in the upstream side contact portion N2, the paper transporting path R1 and the belt moving path R2 are curved toward the belt inner side.

On the downstream side relative to the upstream side contact portion N2 (in the paper contact region ER other than the upstream side contact portion N2), the paper transporting path R1 and the belt moving path R2 are curved toward the belt outer side.

More specifically, in the upstream side contact portion N2, the paper transporting path R1 and the belt moving path R2 have curvature and bulge toward the belt inner side.

On the downstream side relative to the upstream side contact portion N2, the paper transporting path R1 and the belt moving path R2 have curvature and bulge toward the belt outer side.

Also in this example, the load of pressing of the driving roll 43 on the fixing belt 411 is set larger than the load of pressing of the pressing belt module 46 on the fixing belt 411.

In other words, also in this example, plural pressing members (e.g., the driving roll 43 and the pressing belt module 46) that press the sheet of paper P are provided, and the driving roll 43 presses the fixing belt 411 by the largest pressing load among the plural pressing members.

Also in this example, the paper transporting path R1 and the belt moving path R2 are curved toward the belt inner side in a portion (the upstream side contact portion N2) where the driving roll 43 that presses the fixing belt 411 by the largest pressing load and the fixing belt 411 are in contact with each other.

In the paper contact region ER other than the upstream side contact portion N2, the paper transporting path R1 and the belt moving path R2 are curved toward the belt outer side.

Also in this example, a difference between moving velocity of the fixing belt 411 and moving velocity of the sheet of paper P is reduced, and the toner image on the sheet of paper P is less likely to be disturbed.

Specifically, also in this example, when the fixing belt 411 reaches the upstream side contact portion N2, peripheral velocity of the fixing belt 411 is higher than peripheral velocity of the sheet of paper P in the upstream side contact portion N2.

This reduces a degree of decrease in velocity of the fixing belt 411 on a downstream side of the upstream side contact portion N2, thereby reducing a difference in velocity between the fixing belt 411 and the sheet of paper P on the downstream side of the upstream side contact portion N2.

Also in this example, on the downstream side relative to the upstream side contact portion N2, the sheet of paper P that moves at a higher velocity than the fixing belt 411 passes an outer route relative to the fixing belt 411. In other words, the sheet of paper P passes a longer route on which it takes more time to travel than the fixing belt 411.

In this case, the difference in velocity between the sheet of paper P and the fixing belt 411 is further reduced.

In the present exemplary embodiment, the driving roll 43 performs driving, and the pressing belt module 46 is driven so as to follow the fixing belt 411, as described above (as illustrated in FIGS. 3 and 6).

In other words, in the present exemplary embodiment, one of plural pressing members that are pressed against the fixing belt 411 performs rotary driving, and the other pressing member is driven so as to follow the fixing belt 411.

This makes it possible to further reduce the difference in velocity between the fixing belt 411 and the sheet of paper P as compared with a case where both of the driving roll 43 and the pressing belt module 46 perform driving.

In a case where both of the driving roll 43 and the pressing belt module 46 perform driving, a difference in velocity between the fixing belt 411 and the sheet of paper P may undesirably occur due to a difference in rotating velocity (peripheral velocity) between the driving roll 43 and the pressing belt module 46.

Specifically, cases where it is difficult to make the rotating velocity of the driving roll 43 and the rotating velocity of the pressing belt module 46 identical to each other, for example, due to dimensional tolerance can be assumed. In such cases, a difference in velocity between the fixing belt 411 and the sheet of paper P may undesirably occur due to a difference in rotating velocity between the driving roll 43 and the pressing belt module 46.

More specifically, for example, in a case where peripheral velocity of one pressing member (i.e., one of the driving roll 43 and the pressing belt module 46) located on an upstream side is higher than peripheral velocity of the other pressing member (i.e., the other one of the driving roll 43 and the pressing belt module 46) located on a downstream side, the fixing belt 411 slows down between the upstream side contact portion N2 and the downstream side contact portion N1. Meanwhile, the sheet of paper P transported from the upstream side contact portion N2 to the downstream side contact portion N1 travels toward the downstream side contact portion N1 at a higher moving velocity than the fixing belt 411 that has slowed down. In this case, a difference in velocity occurs between the fixing belt 411 and the sheet of paper P.

In contrast to this, in a case where only one of the plural pressing members performs rotary driving as described above, the fixing belt 411 is less likely to slow down between the upstream side contact portion N2 and the downstream side contact portion N1, and a difference in velocity is less likely to occur between the fixing belt 411 and the sheet of paper P.

Figure 7:
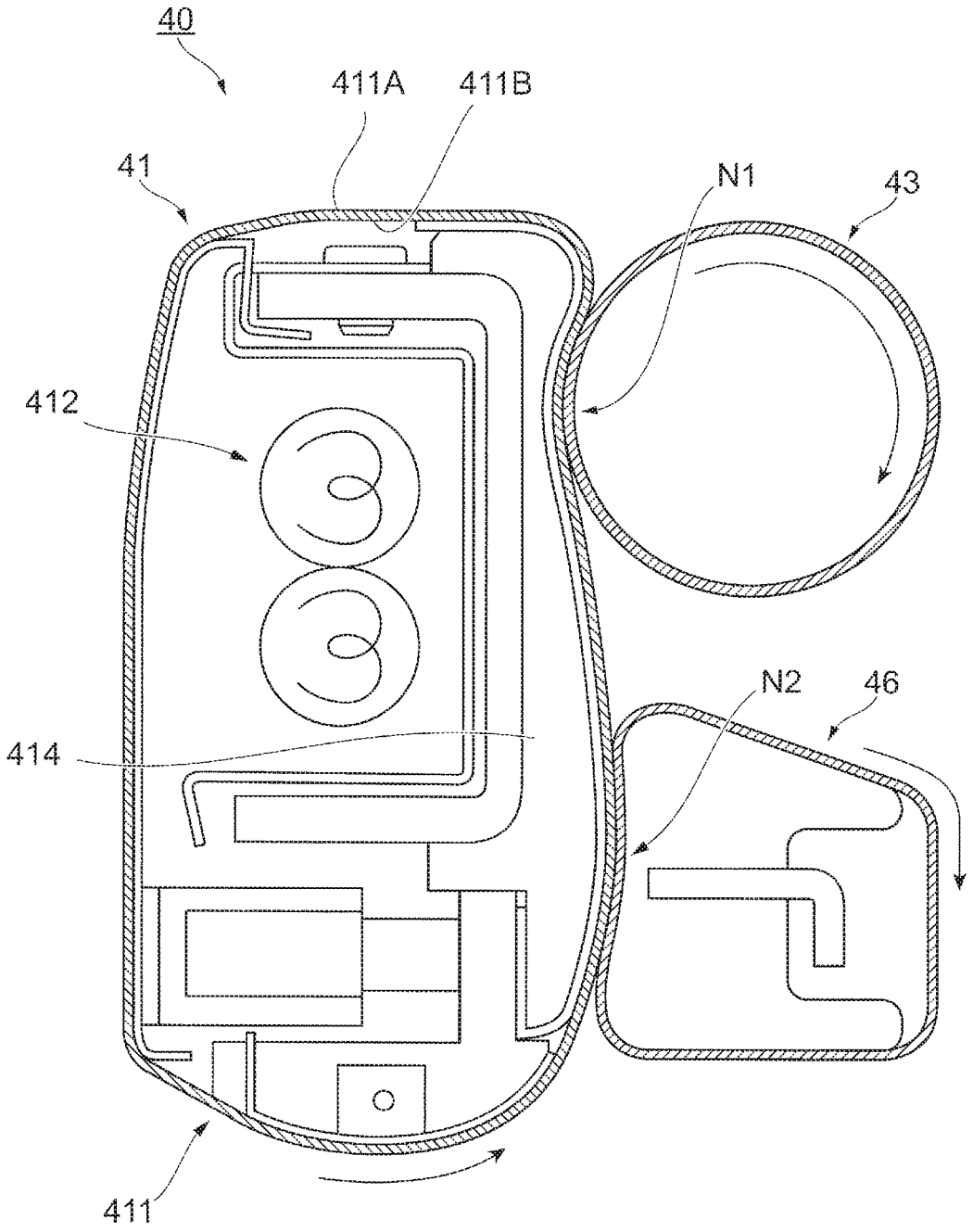
FIG. 7 illustrates another example of the configuration of the fixing device.

FIG. 7 illustrates another example of the configuration of the fixing device 40.

Although the heating source 412 is provided in contact with the inner circumferential surface 411B of the fixing belt 411 in the above example, the heating source 412 may be provided so as not to be in contact with the inner circumferential surface 411B of the fixing belt 411.

In the example illustrated in FIG. 7, the heating source 412 is provided on a side opposite to the upstream side contact portion N2 and the downstream side contact portion N1 with the support member 414 interposed therebetween.

A portion, of the support member 414, corresponding to the upstream side contact portion N2 is curved toward the belt outer side, and a portion, of the support member 414, corresponding to the downstream side contact portion N1 is curved toward the belt inner side. By thus forming the support member 414, the paper transporting path R1 and the belt moving path R2 can be easily curved to a desired shape. In the exemplary embodiment illustrated in FIGS. 2 and 6, the heating source 412 functions as a support member.

In this example, a portion of the inner circumferential surface 411B of the fixing belt 411 on a side opposite to a side where the upstream side contact portion N2 and the downstream side contact portion N1 are located is mainly heated.

A position where the heating source 412 is provided is not limited to the inner circumferential surface 411B side of the fixing belt 411 and may be an outer side of the fixing belt 411. In this case, the fixing belt 411 is heated from the outer side of the fixing belt 411.

Alternatively, the heating source 412 may be provided on both of the inner circumferential surface 411B side and the outer circumferential surface 411A side of the fixing belt 411 so that the fixing belt 411 is heated from the inner side and the outer side of the fixing belt 411.

A heated portion of the fixing device 40 is not limited to the fixing belt 411, and the driving roll 43 or the pressing belt module 46 may be heated.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a belt that has a substantially loop shape, has an outer circumferential surface, and is configured to move along a belt moving path;

a driving roll that is configured to press against the outer circumferential surface of the belt and is configured to press a recording material transported along a recording material transporting path passing between the driving roll and the outer circumferential surface; and a pressing belt that is disposed on an upstream side relative to the driving roll in a moving direction of the belt, is configured to press against the outer circumferential surface, and is configured to press the recording material transported along the recording material transporting path passing between the pressing belt and the outer circumferential surface, wherein in a downstream side contact portion where the outer circumferential surface of the belt and the driving roll are in contact with each other, the belt moving path and the recording material transporting path are curved toward an inner side in a radial direction of the belt, wherein on an upstream side in a recording material transporting direction relative to the downstream side contact portion, the belt moving path and the recording material transporting path are curved toward a side opposite to the inner side, and wherein the driving roll and the pressing belt are both configured to press directly against the outer circumferential surface of the belt without an other belts in between.

2. The fixing device according to claim 1, wherein in the downstream side contact portion, the belt moving path and the recording material transporting path have curvature and bulge toward the inner side.

3. The fixing device according to claim 1, wherein portions, of the belt moving path and the recording material transporting path, that are curved toward the side opposite to the inner side have curvature and bulge toward the side opposite to the inner side.

4. The fixing device according to claim 1, wherein the driving roll is a substantially cylindrical or columnar member and is configured to perform rotary driving for giving driving force to the belt so as to circulate the belt.

5. The fixing device according to claim 4, wherein the pressing belt is configured such that it does not perform rotary driving and does not supply driving force to the belt.

6. The fixing device according to claim 1, further comprising a heater configured to heat the belt, wherein the heater is configured to heat at least a portion, of the belt, located on an upstream side in a belt moving direction that is the moving direction of the belt relative to the downstream side contact portion and on a downstream side in the belt moving direction relative to an upstream side contact portion; and wherein the upstream side contact portion is a portion where the belt and the pressing belt are in contact with each other and is located on an upstream side in the belt moving direction relative to the downstream side contact portion where the belt and the driving roll are in contact with each other.

7. The fixing device according to claim 6, wherein the heater is provided from the upstream side contact portion to the downstream side contact portion and is configured to heat a whole of a portion of the belt from the upstream side contact portion to the downstream side contact portion.

8. An image forming apparatus comprising:

an image forming part comprising a photoconductor, a charger and a print head, wherein the image forming part is configured to form an image on a recording material; and a fixing device configured to fix, on the recording material, the image formed on the recording material by the image forming part, wherein the fixing device is the fixing device according to claim 1.

9. The fixing device according to claim 1, further comprising a press that is provided on an inner circumferential surface side of the belt and is configured to press the recording material transported along the recording material transporting path with the belt interposed therebetween, wherein in the contact portion where the outer circumferential surface of the belt and the driving roll are in contact with each other, the press is curved toward the inner side in the radial direction of the belt, and wherein on the upstream side in the recording material transporting direction relative to the contact portion, the press is curved toward the side opposite to the inner side.

10. The fixing device according to claim 1, wherein the pressing belt is configured to be driven primarily by receiving driving force from the belt.

* * * * *